US005328443A

United States Patent [19]

Lee

[11] Patent Number: 5,328,443

[45] Date of Patent: Jul. 12, 1994

[54] MASSAGE APPARATUS

[76] Inventor: Wen-Pin Lee, 6F, No. 361, Min-Chuan Rd., Taichung City, Taiwan

[21] Appl. No.: 910,645

[22] Filed: Jul. 8, 1992

[51] Int. Cl.[5] ..... A61H 7/00

[52] U.S. Cl. ..... 601/92; 601/93; 601/98; 74/40; 74/42; 74/53; 74/54

[58] Field of Search ..... 128/24.2, 44–49, 128/51, 52, 56, 25 R; 482/146, 147; 74/53, 54, 40, 42

[56] References Cited

U.S. PATENT DOCUMENTS

| | | | |
|---|---|---|---|
| 676,383 | 6/1901 | Goodman | 128/25 R |
| 742,534 | 10/1903 | Wantz | 128/48 |
| 2,088,963 | 8/1937 | Kondo | 74/54 |
| 2,433,548 | 12/1947 | Ecks | 128/49 X |
| 2,648,332 | 8/1953 | Johnson | 128/46 |
| 2,874,689 | 2/1959 | Gavelek | 128/57 X |
| 3,978,851 | 9/1976 | Sobel | 128/49 |
| 4,009,710 | 3/1977 | Inada | 128/44 |
| 4,291,686 | 9/1981 | Miyashiro | 128/52 |
| 4,711,229 | 12/1987 | Hengl | 128/52 |
| 4,785,678 | 11/1988 | McGugan et al. | 74/42 |
| 4,834,075 | 5/1989 | Guo et al. | 128/48 |
| 5,085,207 | 2/1992 | Fiore | 128/44 X |
| 5,092,315 | 3/1992 | Bennett et al. | 128/49 X |
| 5,097,822 | 3/1992 | Francis et al. | 128/44 X |
| 5,107,822 | 4/1992 | Ohashi | 128/52 X |

FOREIGN PATENT DOCUMENTS

| | | | |
|---|---|---|---|
| 3251246 | 11/1991 | Japan | 128/48 |

*Primary Examiner*—Robert A. Hafer
*Assistant Examiner*—Brian E. Hanlon
*Attorney, Agent, or Firm*—Curtis, Morris & Safford

[57] ABSTRACT

The massage apparatus includes a casing having a bottom and a top with an elongated opening formed through it. An elongated support is provided on the top of the casing in the direction of the elongated opening. A pair of spaced upright rods is pivotally mounted on the bottom of the casing. An inverted T-shaped frame includes two lateral arms pivotally mounted to upper ends of the upright rods and an intermediate arm upwardly extending from the two lateral arms and through the elongated opening of the top to connect with the support. A driving unit provided in the casing moves the upright rods to swing about the pivot point within a predetermined angle when the driving unit is actuated.

3 Claims, 11 Drawing Sheets

MASSAGE APPARATUS

BACKGROUND OF THE INVENTION

1. FIELD OF INVENTION

The invention relates to a massage apparatus, more particularly to a massage apparatus which has a massage means that moves in a wavy manner so as to provide a massage by rubbing and kneading to the body part disposed on it.

2. DESCRIPTION OF THE RELATED ART

Referring to FIGS. 1 and 2, a conventional massage apparatus includes a casing (1) having a base bottom (2) and a top with an elongated opening (14) provided therethrough and an actuating switch (12) for operating the massage apparatus. An elongated support means (3) having two curved portions (31) to receive body parts, such as the calf of a leg, is provided on the top of the casing (1) extending in the direction of the elongated opening (14). A driving unit is mounted on the base bottom (2) and has a speed reduction gear (5) with a driving shaft (51). A rectangular driving plate (52) is eccentrically fixed to the driving shaft (51). The driving plate (52) further includes a driving wheel (54) fixed thereto. A mounting frame (6) with two spaced apart guide rails (62) is mounted adjacent to the driving unit in the casing (1). A sliding plate (4) which has an oval-shaped opening at an intermediate portion is slidably attached to the mounted frame (6). The sliding plate (4) has a top portion extending through the elongated opening of the top of the casing (1) and screw-connected to the elongated support means. After the massage apparatus is assembled, the periphery of the driving wheel (54) rotatably contacts the oval-shaped opening of the sliding plate (4). Thus, once the driving unit is actuated, the sliding plate (4) moves to and fro in a horizontal direction, moving the elongated support means (3) lengthwise due to a rotation of the rectangular driving plate (51), thereby providing a massage to the body part put thereon.

A drawback of the above-mentioned massage apparatus is that since the support member supporting the body part to be massaged moves to and fro only in the direction of the elongated opening, the body part is massaged only in that direction.

SUMMARY OF THE INVENTION

A main object of the present invention is to provide a massage apparatus which can provide an additional massage effect in addition to that provided by a horizontal direction massage, such as by combining kneading type massages and rubbing type massages, because the massage part of the massage apparatus moves in a wavy manner.

Accordingly, the massage apparatus of the present invention includes a casing having a base bottom and a top with an elongated opening therethrough; an elongated support means provided on the top of the casing above and extending in the direction of the elongated opening; a pair of spaced upright rods pivotally mounted on the bottom; a substantially inverted T-shaped frame with two lateral arms pivoted to upper ends of the spaced upright rods and an intermediate arm upwardly extending from the two lateral arms and projecting through the elongated opening to connect with the elongated support means; and a driving unit provided in the casing and having means for moving the spaced upright rods so as to swing within a predetermined angle in the casing.

BRIEF DESCRIPTION OF THE DRAWINGS

Other features and advantages of the present invention will become more apparent in the following detailed description, including drawings, all of which show a non-limiting form of the present invention, and in which.

DETAILED DESCRIPTION OF THE PREFERRED EMBODIMENT

Figure 1:
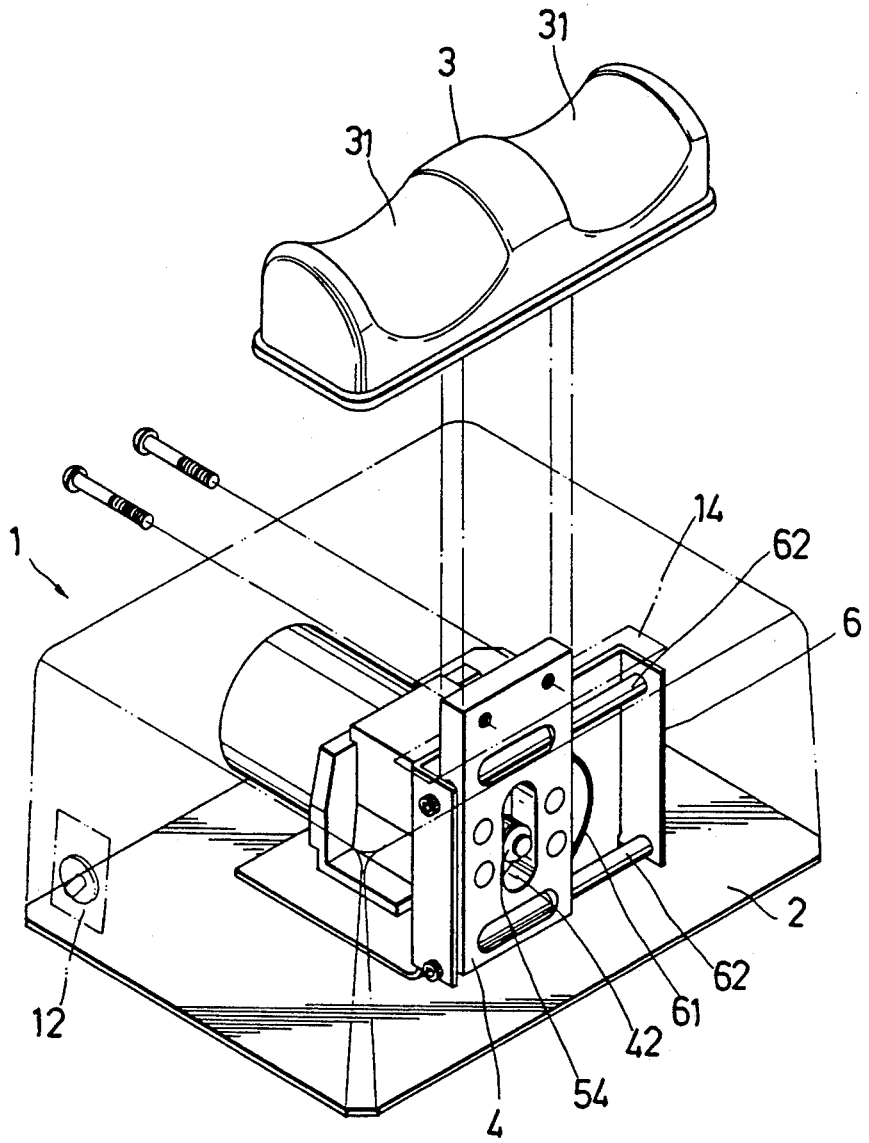
FIG. 1 PRIOR ART
FIG. 1 shows a partially exploded view of a massage apparatus of the prior art.
Figure 2:
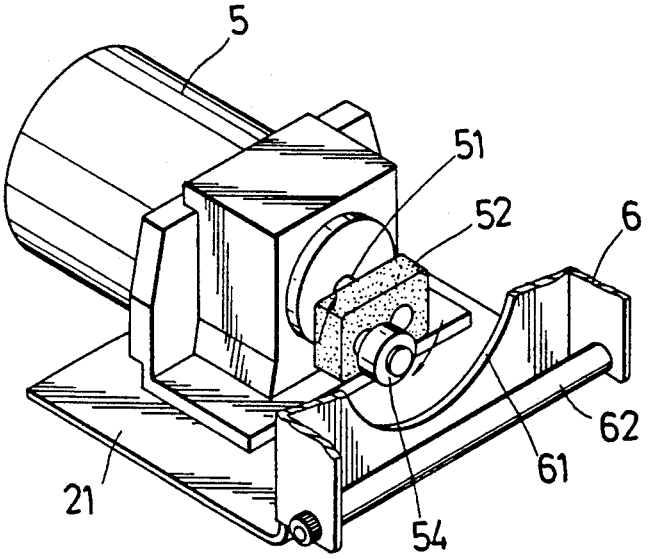
FIG.2 PRIOR ART
FIG. 2 shows a driving mechanism of the massage apparatus of FIG. 1.
Figure 3:
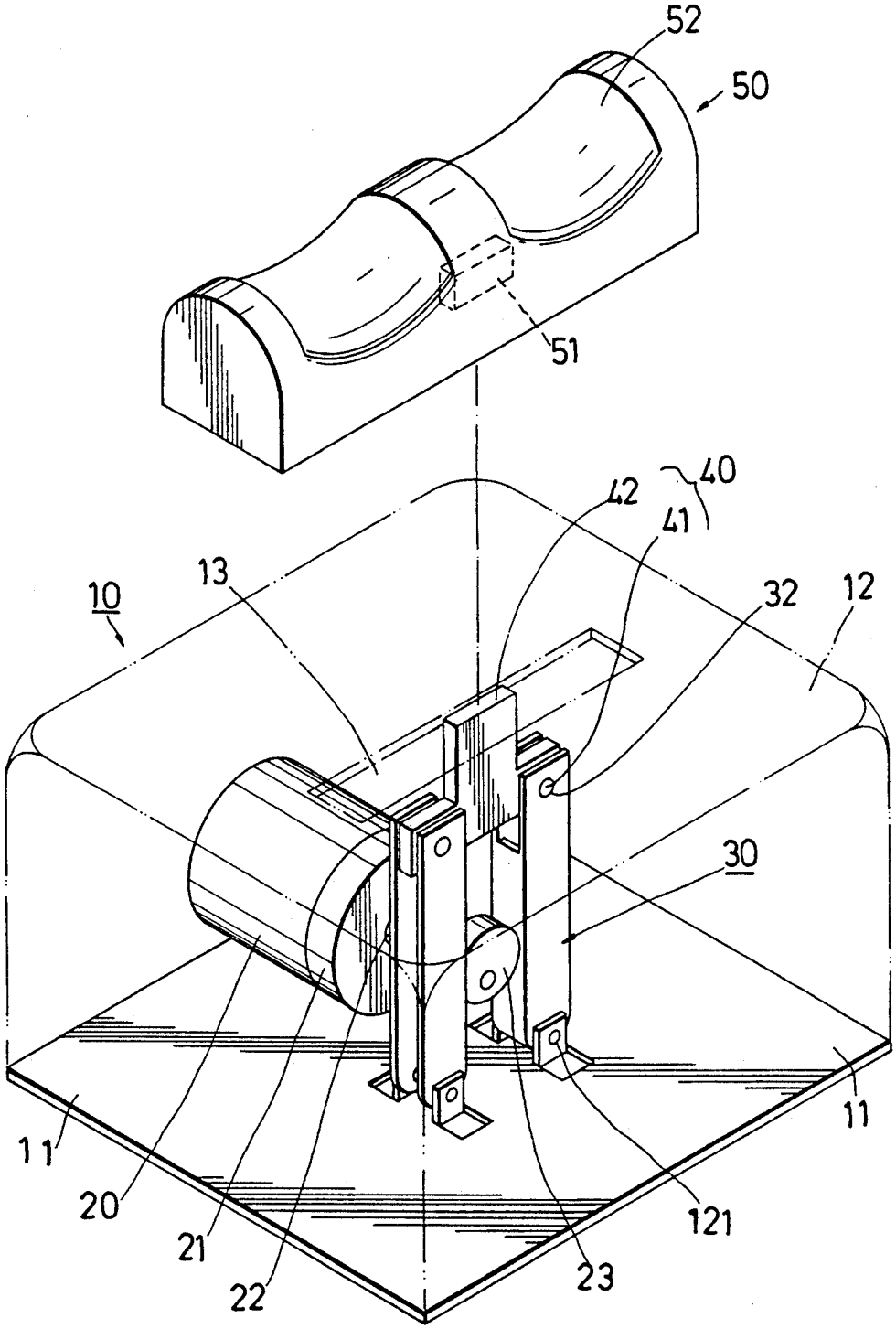
FIG. 3 shows a partially exploded view of a massage apparatus of the present invention.
Figure 4:
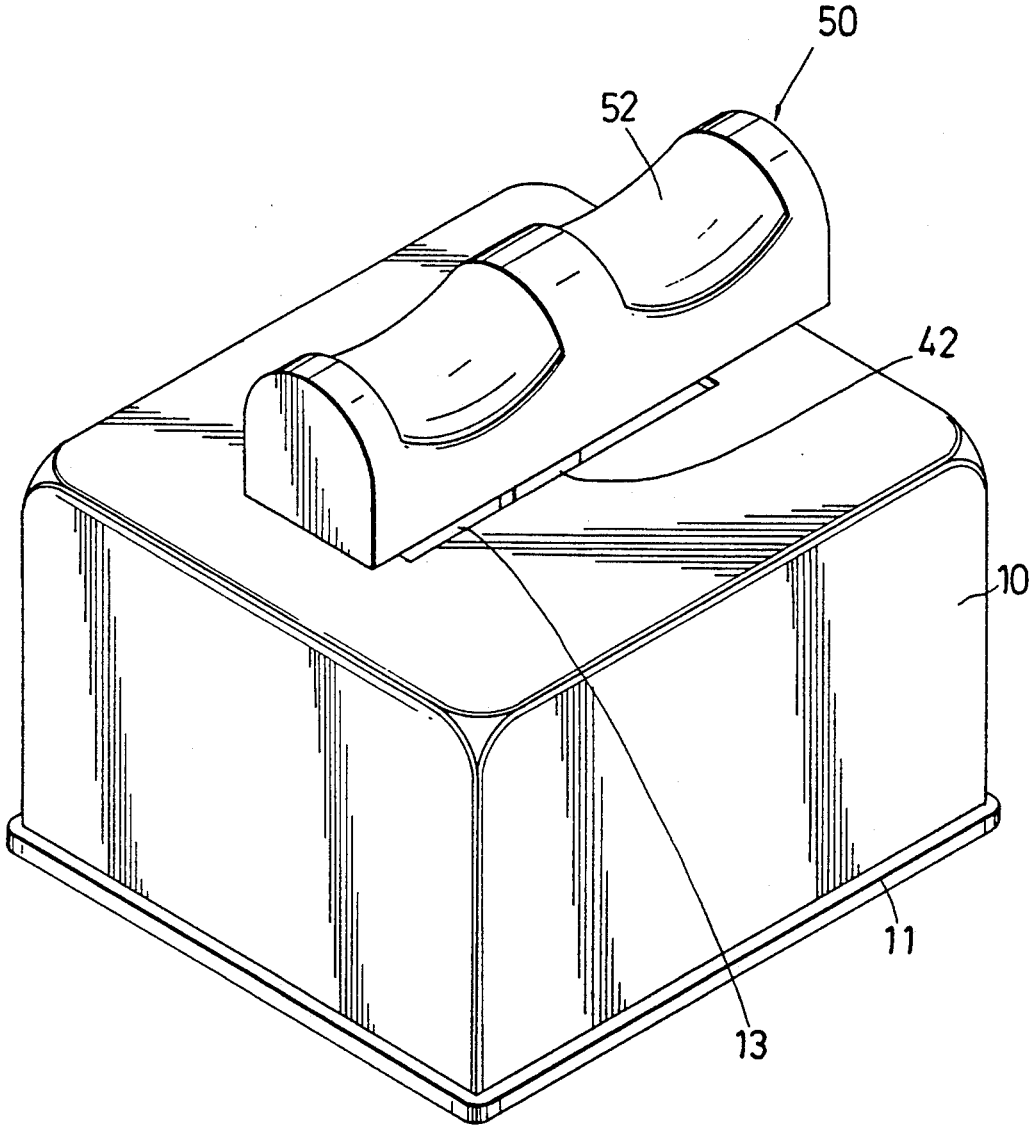
FIG. 4 shows a perspective, schematic view of a massage apparatus of the present invention.

Referring to FIGS. 3 and 4, a massage apparatus of the present invention is shown to comprise a casing (10) having a bottom (11) and a top (12) with an elongated opening (13) disposed therethrough and an actuating switch (not shown) for operating the massage apparatus. An elongated support means (50) with two curved receiving spaces (52) for supporting the body part to be massaged is disposed on the top of the casing (10) above and extending in the direction of the elongated opening (13).

The driving unit (20), such as a motor, employed in this preferred embodiment includes a speed reduction gear (21) with a driving shaft (22) to which a driving wheel (23) is eccentrically mounted thereto. A pair of spaced upright rods (30) having a substantially U-shaped configuration in cross section is pivotally mounted on the two brackets (121) disposed on the bottom (11) of the casing (10).

A substantially inverted T-shaped plate (40) has two lateral arms (41) pivoted on upper ends (32) of the upright rods (30) and an intermediate arm (42) upwardly extending from the two lateral arms (41), through the elongated opening (13) and into a recessed groove (51) of the elongated support means (50) so as to connect the elongated support. The upwardly extending intermediate arm has an uppermost point.

Figure 5:
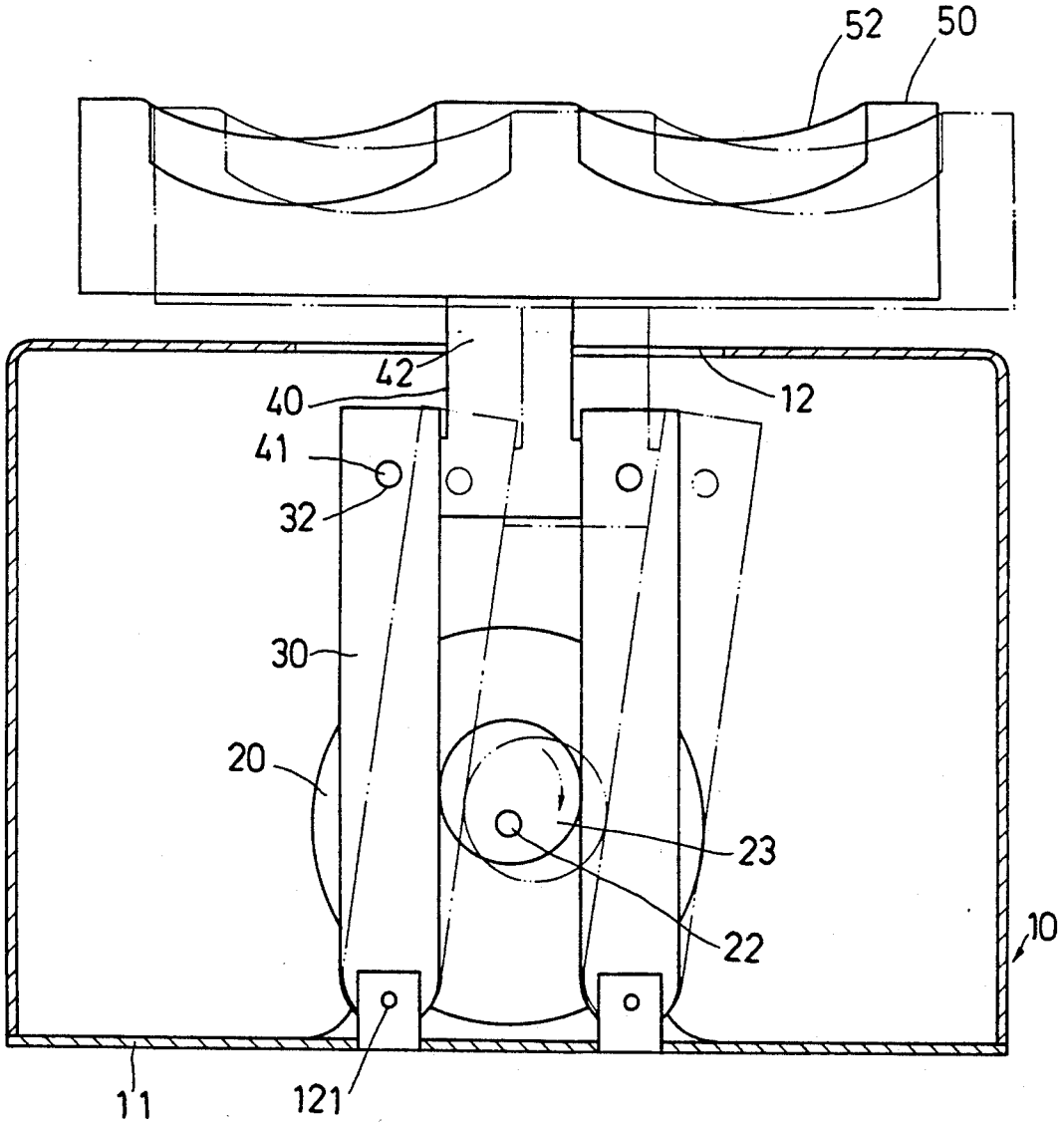
FIGS. 5 and 6 show the massage apparatus of the present invention in operation.
Figure 6:
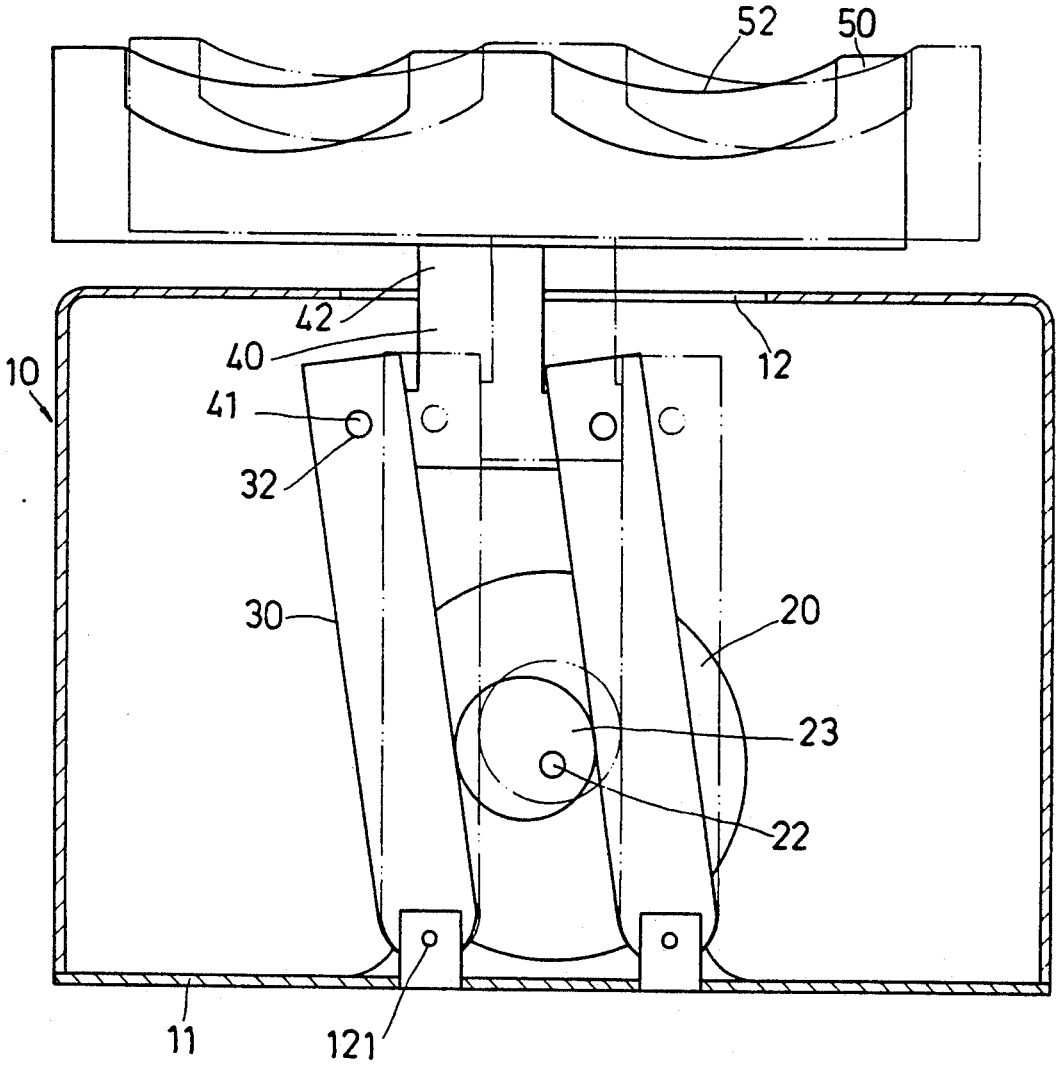

After the massage apparatus is assembled, the driving wheel (23) is positioned between the upright rods (30) whereat the periphery of the driving wheel (23) rotatably contacts the upright rods (30). When the driving unit (20) is actuated, the upright rods (30) swing within a predetermined angle in the casing (10) as shown in FIGS. 5 and 6, correspondingly moving the elongated support means (30) to and fro in a wavy manner along the elongated opening (13) so as to provide a massage effect to the body part disposed on the curved portion (52) as in the prior art apparatus. It is important to note that while the elongated support means (50) swings to and fro, it also moves up and down because the uppermost point of the intermediate arm travels in a curved line, as shown by perforated lines, which action provide massage effects by rubbing and kneading to the body part disposed on the support member.

Figure 7:
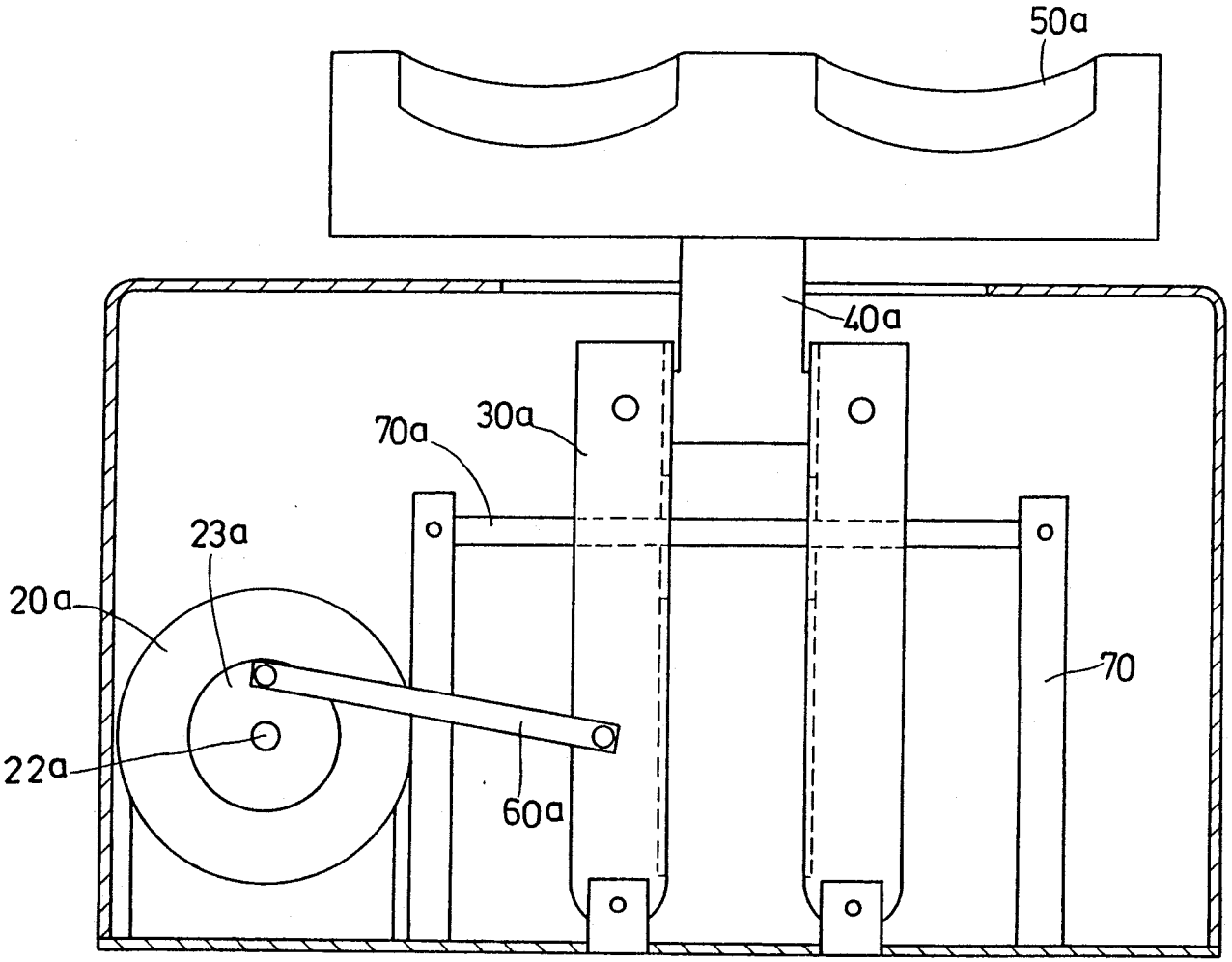
FIG. 7 shows a second preferred embodiment of the massage apparatus of the present invention.

Referring to FIG. 7, the speed reduction gear (20*a*) of the driving unit in a second preferred embodiment includes a driving shaft (22*a*) to which a driving wheel (23*a*) is concentrically mounted thereto. A connecting rod (60*a*) includes a first end eccentrically connected to the driving wheel (23*a*) and a second end pivotally connected to an intermediate portion of one of the upright rods (30). A pair of limiting upright rods (70) respectively disposed on both side of the upright rods (30*a*) and connected by a connecting rod (70*a*) to limit the swinging angle of the upright rods (30*a*). Thus when the driving unit is actuated, the support means (50*a*) swings to and fro within the predetermined angle. The feature and object are the same as in the previous embodiment.

Figure 8:
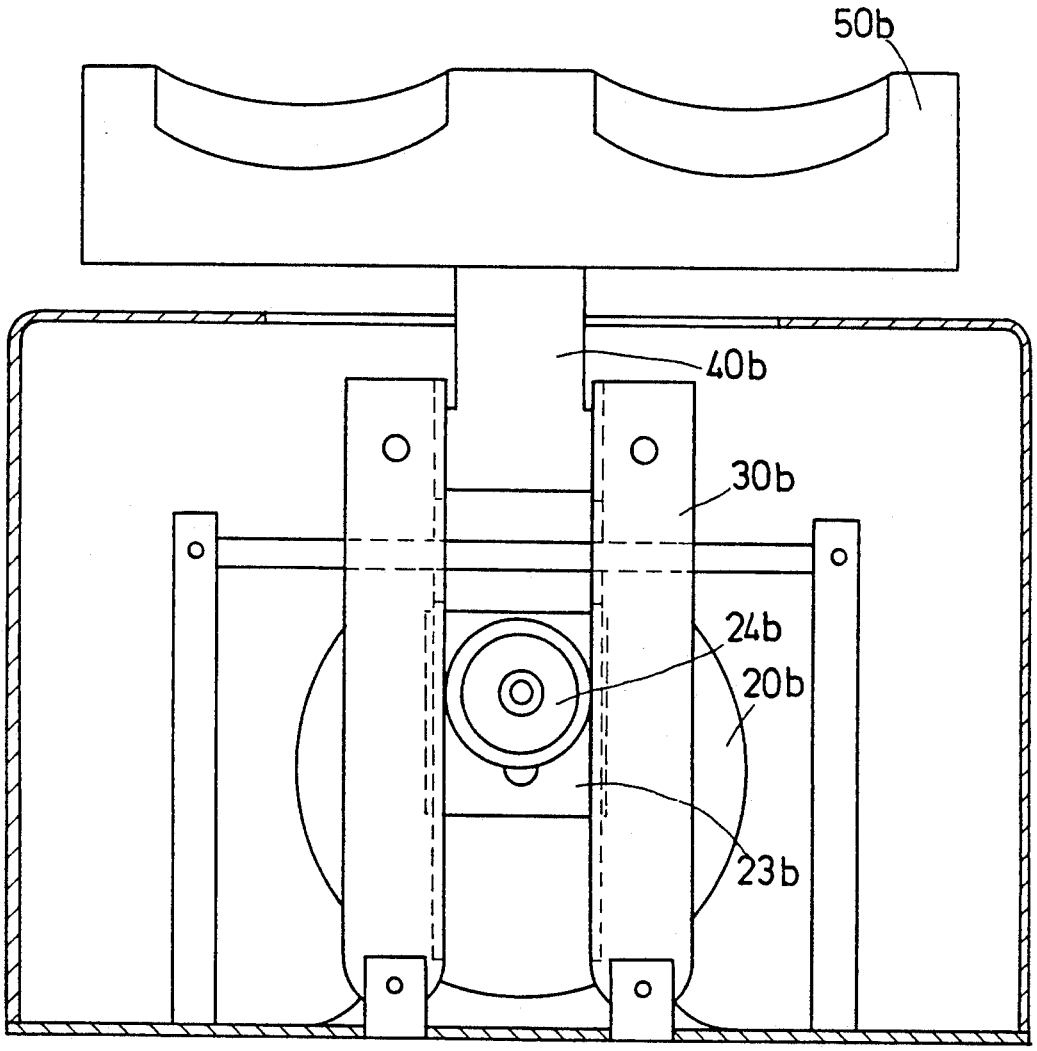
FIG. 8 shows a third preferred embodiment of the massage apparatus of the present invention.
Figure 9:
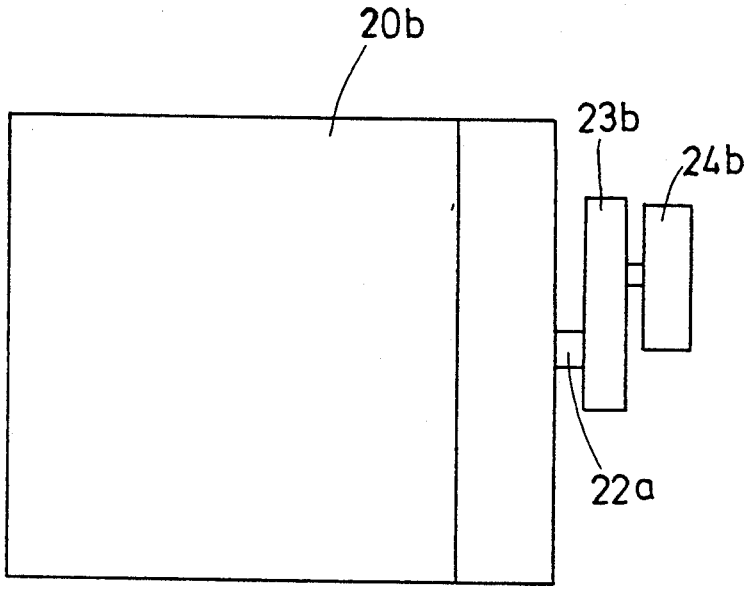
FIG. 9 shows a side view of the driving unit of the third preferred embodiment of the massage apparatus of FIG. 8.

Referring to FIGS. 8 and 9, the speed reduction gear of the driving unit (20*b*) in the third preferred embodiment has a driving shaft (22*a*) to which a driving plate (23*b*), is eccentrically mounted thereto. A driven wheel (24*b*) is connected to the driving plate (23*b*) and is positioned between the two upright rods (30*b*) and has a periphery rotatably contacted with the upright rods so that when the driving unit is actuated, the upright rods (30*b*) swing to and fro within a predetermined angle. The feature and object are the same as in the previous embodiment.

Figure 10:
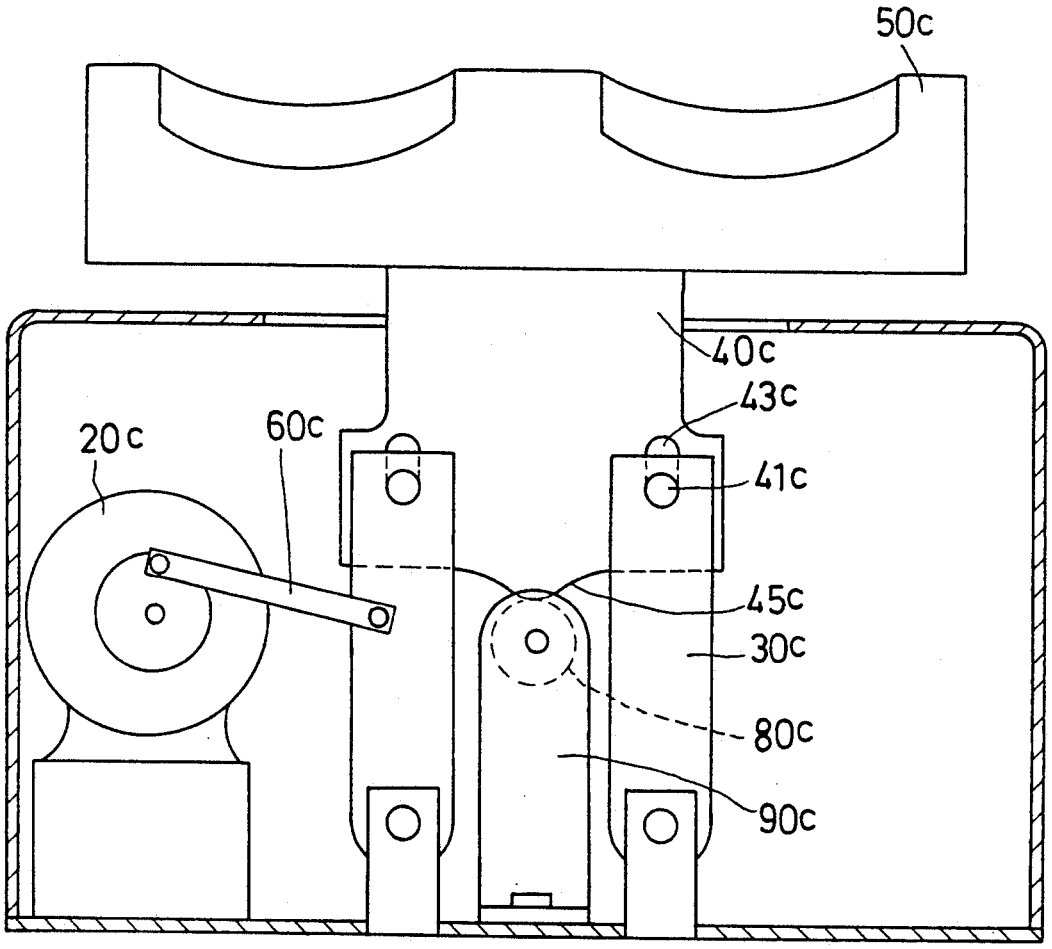
FIG. 10 shows a fourth preferred embodiment of the massage apparatus of the present invention.
Figure 11:
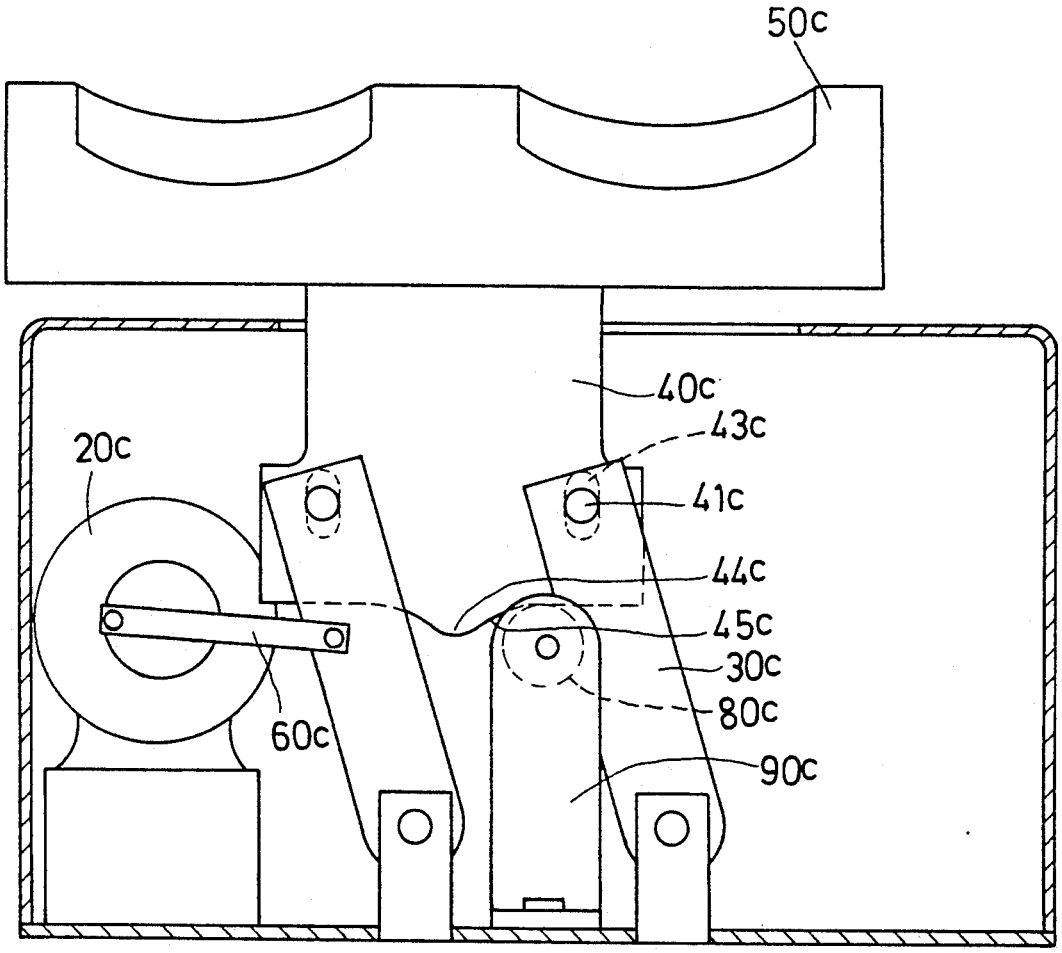
FIG. 11 shows the fourth preferred embodiment of the massage apparatus of FIG. 10 in operation.

Referring to FIGS. 10 and 11, the preferred embodiment is similar to that shown in FIG. 7, the only difference being that each of the two lateral arm has an elongated hole (43*c*) pivoted to upper ends (41*c*) of the upright rods (30*c*) and a curved projection (45*c*) extending downward from an intermediate portion of the two arms. A support rod (90*c*), which top end has a wheel (80*c*) supporting the curved projection (45*c*), is disposed between the two upright rods (30*c*) in the casing. When the driving unit is actuated, the elongated support means (50*c*) swings within a predetermined angle. The feature and object are the same as in the other embodiment.

While a preferred embodiment has been illustrated and described, it will be apparent that many changes and modifications may be made in the general construction and arrangement of the present invention without departing from the spirit and scope thereof. Therefore, it is desired that the present invention be limited not to the exact disclosure but only to the extent of the appended claims.

I claim:

1. A massage apparatus, comprising:

a casing having a bottom and a top with an elongated opening;

an elongated support means for supporting a body part to be massaged which extends movably above said casing and is aligned with said elongated opening of said casing, said elongated support means having a concave face for providing a continuous massaging effect on a section of the body part positioned thereon;

a pair of spaced upright rods pivotally mounted on said bottom of said casing;

a substantially inverted T-shaped frame having two lateral arms pivoted on upper ends of said upright rods and an intermediate arm upwardly extending from said two lateral arms and projecting through said elongated opening to connect with said elongated support means, said T-shaped frame in cooperation with said upright rods providing a wavy traveling path of said elongated support means; and a driving unit provided in said casing and having means for moving said upright rods so as to swing to and fro about said pivot points within a predetermined angle in said casing.

2. A massage apparatus as claimed in claim 1, wherein said moving means includes a driving shaft which has a driving wheel eccentrically mounted thereto, said driving wheel being positioned between said upright rods, and a periphery of said driving wheel being rotatably in contact with said upright rods.

3. A massage apparatus as claimed in claim 1, wherein said moving means includes a driving shaft having a driving wheel concentrically mounted thereto and an elongated rod having one end eccentrically connected to said driving wheel and another end pivotally connected to an intermediate portion of one of said upright rods.

* * * * *